US009878559B2

(12) United States Patent
Aroneo et al.

(10) Patent No.: US 9,878,559 B2
(45) Date of Patent: Jan. 30, 2018

(54) DUAL MODE PRINTER

(71) Applicant: Impress Systems, Chelmsford, MA (US)

(72) Inventors: Stephen L. Aroneo, Franklin Lakes, NJ (US); Oleksandr Ryzhenko, Woburn, MA (US)

(73) Assignee: Impress Systems, Chelmsford, MA (US)

( * ) Notice: Subject to any disclaimer, the term of this patent is extended or adjusted under 35 U.S.C. 154(b) by 88 days.

(21) Appl. No.: 14/862,368

(22) Filed: Sep. 23, 2015

(65) Prior Publication Data

US 2016/0082757 A1 Mar. 24, 2016

Related U.S. Application Data

(60) Provisional application No. 62/053,996, filed on Sep. 23, 2014.

(51) Int. Cl.
*B41J 2/335* (2006.01)
*B41J 2/325* (2006.01)
(Continued)

(52) U.S. Cl.
CPC ..... *B41J 2/335* (2013.01); *B41J 2/325* (2013.01); *B41J 3/28* (2013.01); *B41J 3/4073* (2013.01); *B41J 25/304* (2013.01)

(58) Field of Classification Search
CPC . B41J 25/001; B41J 3/28; B41J 3/4073; B41J 2/325; B41J 2/335
See application file for complete search history.

(56) References Cited

U.S. PATENT DOCUMENTS 6,005,595 A * 12/1999 Vanwey ..... B41J 25/304 347/171
6,493,014 B2 12/2002 Aroneo
(Continued)

FOREIGN PATENT DOCUMENTS

CN 2830071 10/2006
WO WO 2010078710 7/2010

OTHER PUBLICATIONS

Ivanov, Alexander (Александр Иванов), "Печать на ручках принтером Foil Print x4 (Printing on the handles of the printer Foil Print x4)", YouTube, uploaded by Virshke, published on Jul. 7, 2014, https://www.youtube.com/watch?v=25aZnwq4gl8&feature=player_embedded>.

*Primary Examiner* — Julian Huffman
*Assistant Examiner* — Michael Konczal
(74) *Attorney, Agent, or Firm* — Cesari and McKenna, LLP; Patricia A. Sheehan

(57) ABSTRACT

A thermal transfer flat bed printer that is configured for printing on flat objects includes a removable cylinder print module that is installed between a print head and the flat bed. The cylinder print module includes an alignment mechanism that engages with an alignment subsystem that moves with the print head and is separated from the print head by a predetermined distance. The engagement between the alignment mechanism and the alignment subsystem positions the module relative to the print head such that a cylindrical object supported by the module is in precise alignment with the print head, to within the tight tolerances associated with cylinder printing. The cylinder print module, which rests on but does not attach to the printer flat bed, includes rollers that are arranged to both support the cylindrical object and control the rotation of the cylindrical object, to maintain the
(Continued)

cylindrical object in precise alignment with the print head during a cylinder print operation.

14 Claims, 7 Drawing Sheets

(51) Int. Cl.

| | |
|---|---|
| ***B41J 3/28*** | (2006.01) |
| ***B41J 3/407*** | (2006.01) |
| ***B41J 25/304*** | (2006.01) |

(56) References Cited

U.S. PATENT DOCUMENTS

| | | | | |
|---|---|---|---|---|
| 6,570,600 | B2 | 5/2003 | Aroneo et al. | |
| 7,407,250 | B2 * | 8/2008 | Jones | B41J 2/335<br>347/101 |
| 9,193,176 | B2 * | 11/2015 | Kohrs | B41J 3/4073 |
| 2002/0097315 | A1 | 7/2002 | Aroneo et al. | |
| 2004/0175218 | A1 * | 9/2004 | Katzer | B41J 3/4073<br>400/61 |

* cited by examiner

DUAL MODE PRINTER

CROSS-REFERENCE TO RELATED APPLICATIONS

The present application claims the benefit of U.S. Provisional Patent Application Ser. No. 62/053,996, which was filed on Sep. 23, 2014, by Stephen L. Aroneo et al. for a DUAL MODE PRINTER and is hereby incorporated by reference.

BACKGROUND OF THE INVENTION

Field of the Invention

The present invention relates generally to on-demand digital thermal transfer printer systems, and more particularly, to thermal printer systems that print on both flat objects and cylindrical objects.

Background Information

Thermal transfer printer systems, such as Impress Systems Foil Xpress printers, operate on-demand to accurately and efficiently print alphanumeric information and designs, such as logos, titles and so forth, directly onto essentially flat objects such as, for example, book covers, greeting cards, and the like. Thermal transfer cylinder printer systems, such as Impress Systems Cyclone printers, operate on-demand to accurately and efficiently print alphanumeric information and designs directly onto a variety of cylindrical objects, such as pens, pencils, cosmetic items, medical devices (e.g., syringe barrels), and so forth. The cylinder thermal printers are further discussed in U.S. Pat. No. 6,570,600, which is assigned to Impress Systems and is incorporated herein by reference.

There is a potential for savings in terms of both cost and efficiency if both flat and cylindrical printing functions could be performed a single printer. However, the requirements for the alignment between a print head and the flat object and the print head and the cylindrical object differ. More specifically, the alignment between the print head and the cylindrical object must be extremely precise, on the order of two thousandths of an inch, to ensure printing occurs accurately on the curved surface of the cylindrical object. Accordingly, a printer that prints on both flat and cylindrical objects must maintain the requisite alignment tolerances associated with the printing on the cylindrical objects whenever the printer is utilized to print on cylindrical objects.

SUMMARY OF THE INVENTION

To accomplish the foregoing and other objects, features and advantages, we have provided a removable cylinder print module that operates with a thermal transfer flat bed printer that is configured for printing on flat objects, to allow the printer to print also on cylindrical objects. The cylinder print module includes an alignment mechanism that engages with an alignment component of an alignment subsystem that moves with the print head and is separated from the print head by a predetermined distance. The engagement between the alignment mechanism and the alignment subsystem positions the module relative to the print head such that a cylindrical object supported by the module is in precise alignment with the print head, to within the tight tolerances associated with cylinder printing. The cylinder print module, which rests on but does not attach to the printer flat bed, includes rollers that are arranged to both support the cylindrical object and control the rotation of the cylindrical object, to maintain the cylindrical object in precise alignment with the print head during printing. The removable cylinder print module provides and maintains the accuracy required for printing on cylindrical objects within the requisite tolerances when the module is attached as well as when the module is removed and reattached.

BRIEF DESCRIPTION OF THE DRAWINGS

The invention description below refers to the accompanying drawings, of which.

DETAILED DESCRIPTION OF AN ILLUSTRATIVE EMBODIMENT

Figure 1:
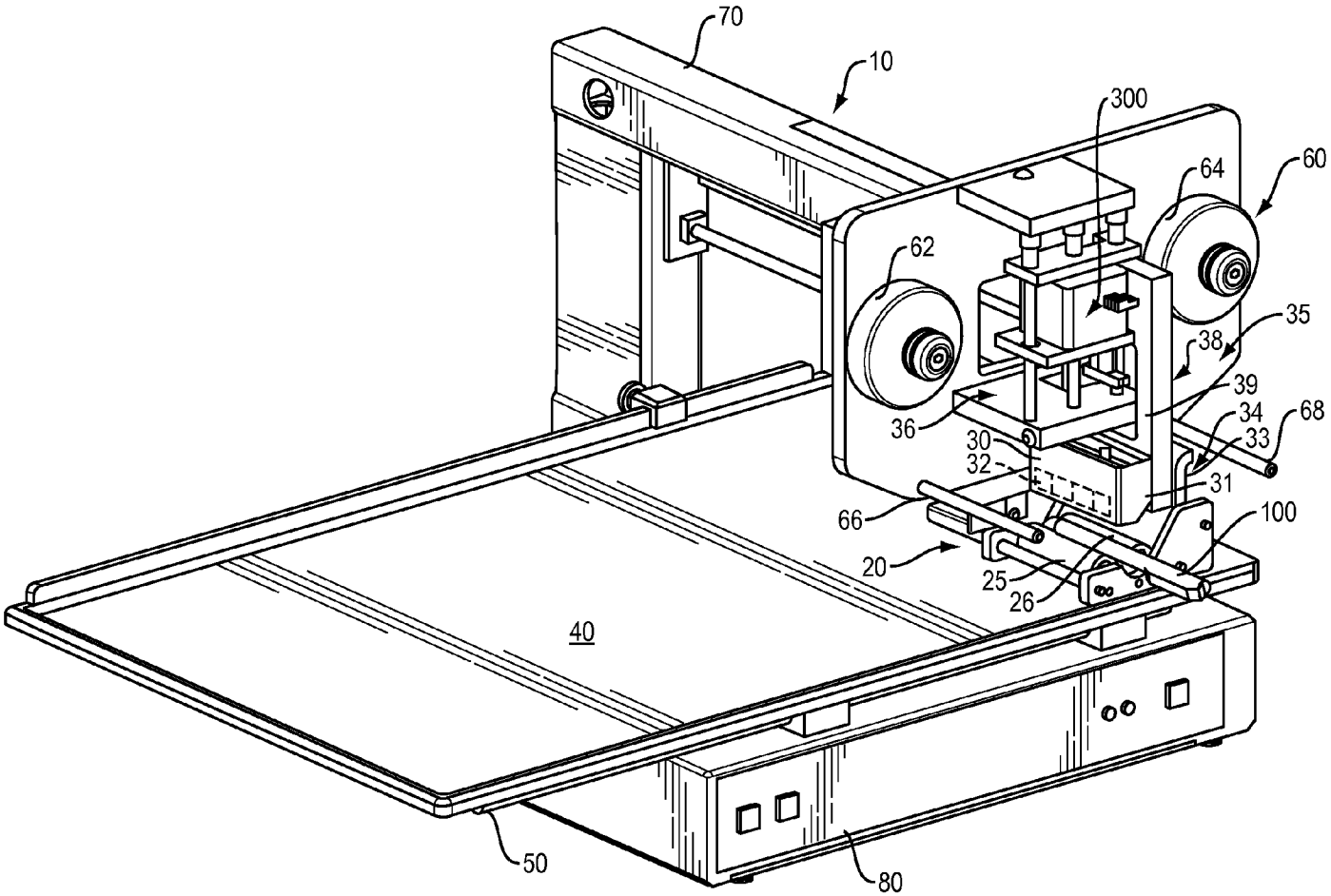
FIGS. 1 and 2 illustrate a flat bed printer system with a cylinder print module in place.
Figure 2:
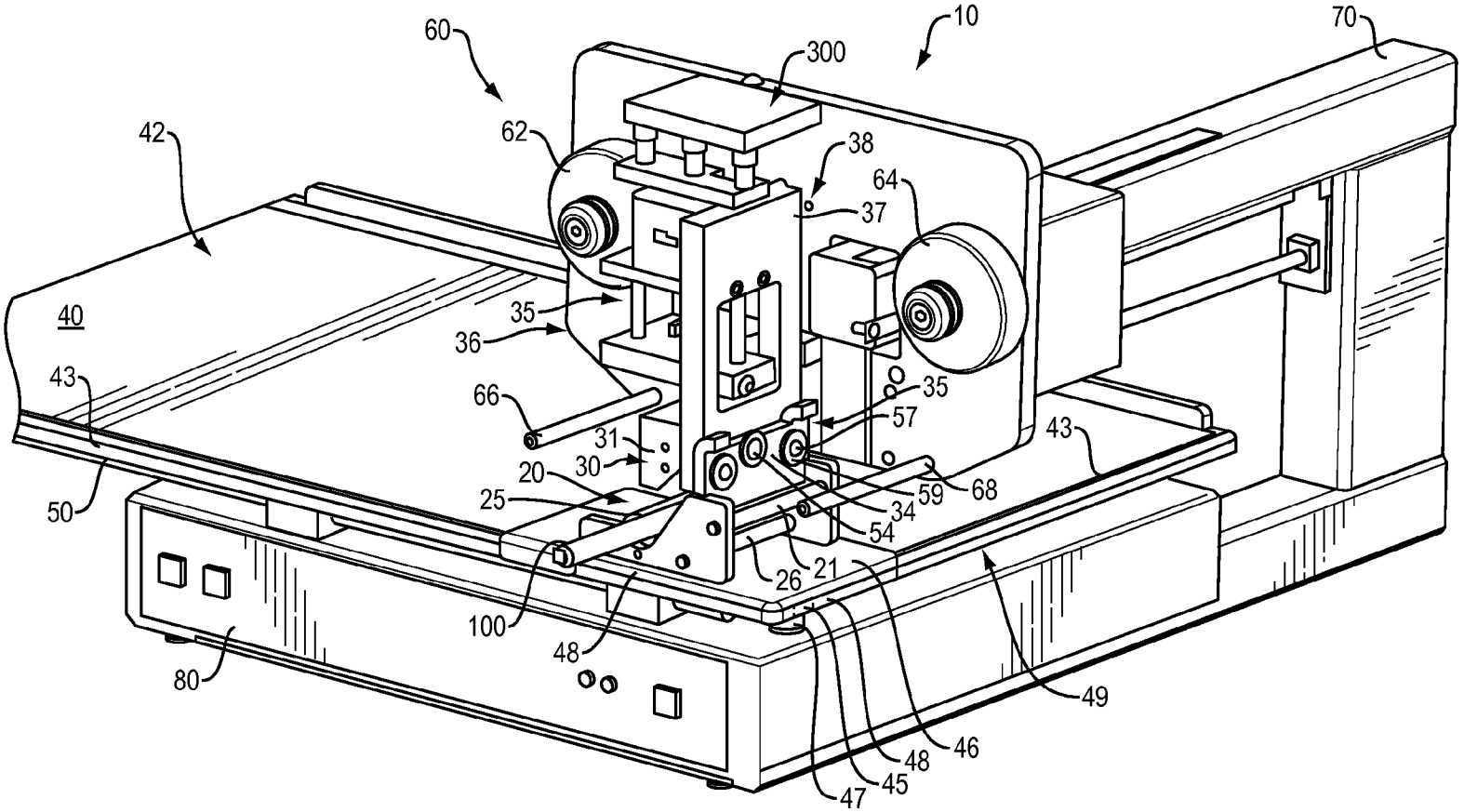

Referring to FIGS. 1 and 2, a dual mode printer 10, which prints on both flat objects and cylindrical objects using a print head 30, is illustrated with a removable cylinder print module 20 installed for printing on a cylindrical object 100. In the drawing the cylindrical object is illustrated as a pen.

The cylinder print module 20 rests on but it not attached to a flat bed 40 that moves on one or more rails 50. During printing operations on flat objects, the flat bed supports and moves the flat objects along an X-axis relative to the print head 30. In the system as shown, the flat bed 40 moves along rails 50 under the direction of a motor (hidden from view in the drawing) that is part of a control sub-system 80. The control sub-system, in turn, operates under the control of a microprocessor that directs the control sub-system to perform the desired print operation based on design information and object dimensions provided by a user via, for example, a graphical user interface displayed on a computer that communicates with the microprocessor. For ease of understanding, the computer and the microprocessor, as well as the various motors and associated transmission assemblies that are directed by the control sub-system, and which all operate in known manners, are not shown.

The printer 10 utilizes a thermal media, such as a thermal transfer ribbon or hot stamp foil that is advanced by a thermal assembly 60. The thermal assembly 60 includes a supply mount 62 and a take-up mount 64 on which a thermal media supply roll and a thermal media take-up roll may be rotatably mounted. The control sub-system 80 controls the rotation of at least one of the mounts by a motor and, as appropriate, a transmission assembly, in a known manner, to direct the advancement of the thermal media during the printing operations. The motor that controls the rotation of the one or both of the mounts may, but need not, be the same motor that controls the movement of the flat bed 40 along the rails 50. The thermal media assembly further includes a pair of guide rods 66 and 68 that are situated in the path of the thermal foil to assist in keeping the thermal media properly tensioned and aligned with the print head during media advancement and printing. The guide rods also minimize the creasing and wrinkling of the thermal media.

The control sub-system 80 also controls, by motor and, as appropriate, an associated transmission assembly, the movement of a print head assembly 300 that positions the print head 30 for the printing operations. As directed by the control sub-system, the print head assembly operates in a known manner to move the print head along a rail 70, to position the print head along a Y-axis relative to a flat object to be printed. Alternatively, the print head assembly may be moved along the rail 70 by a user, who then tightens the print head assembly in place on the rail for printing. As also directed by the control sub-system, the print head assembly 300 further operates in a known manner to move the print head 30 downwardly along a Z-axis to begin a print operation and upwardly to end the printing operation, as discussed in more detail below.

The print head 30, which may be a true edge, a near edge or a convex type, includes a plurality of spaced-apart linearly arranged heating elements 32, shown by dotted lines in the drawing. The control sub-system 80 further controls the timing of the strobing of the print head 30 and the activation of an associated pressure mechanism 36, e.g., a pneumatic actuator or motor system, to apply both heat and pressure to the thermal media during print operations in a known manner. The combination of heat and downward pressure cause portions of the thermal media to detach from its carrier and adhere to the surface of the flat or cylindrical object being printed.

Figure 3:
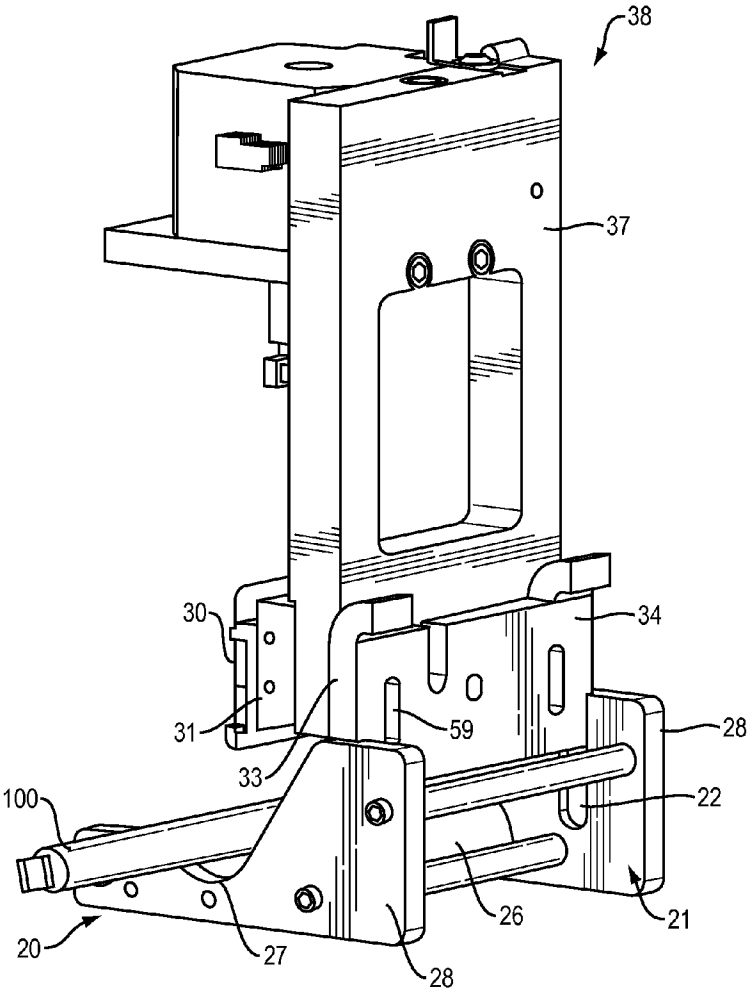
FIGS. 3 and 4 show the cylinder print module of FIGS. 1 and 2 in more detail.
Figure 4:
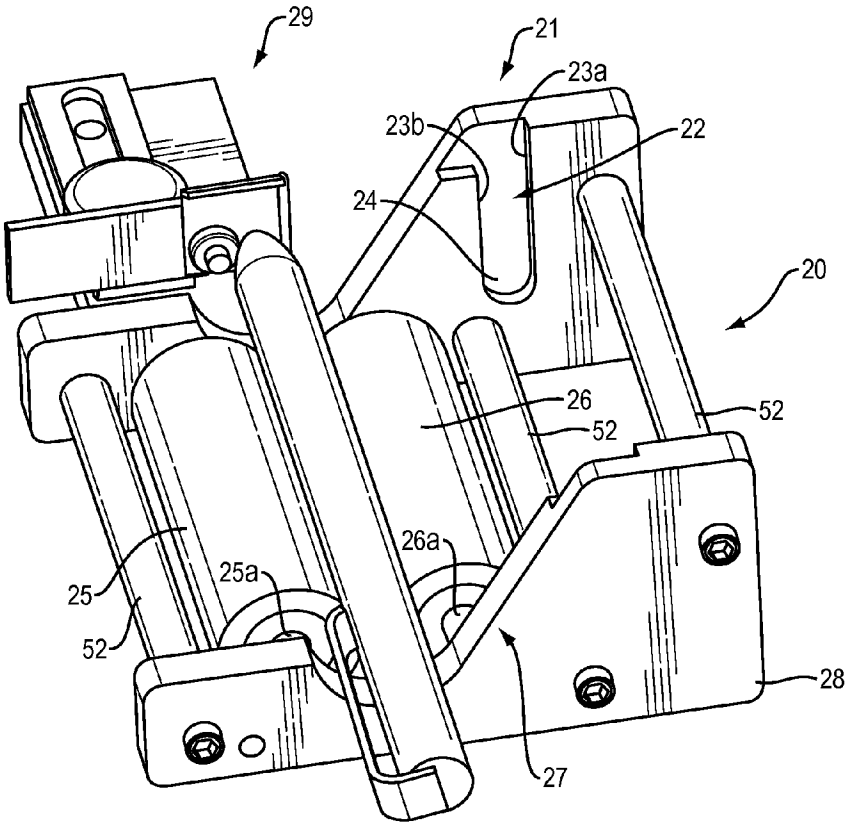

Referring now also to FIGS. 3 and 4, an alignment mechanism 21 on the cylindrical print module 20 engages with an alignment subsystem 35 that includes an alignment component, in the example, an alignment blade 34, that is supported on a first wall 37 of a nose plate 38 that connects to and moves with the print head assembly 300. The print head 30 is supported on an opposite side of the nose plate 38 and is connected by a bracket 31 to a second wall 39 of the nose plate. The print head 30 and the alignment blade 34 are separated along an X-axis by a known distance, here by the thickness of the nose plate 38 and the bracket 31. The engagement of the alignment blade 34 by the alignment mechanism 21 of the cylinder print module 20 ensures that the module is precisely positioned along the X-axis relative to the print head 30.

The cylinder print module 20 includes rollers 25 and 26 that support and control the rotation of the cylindrical object 100 during the printing operation. A predetermined spacing between the rollers relative to the alignment mechanism 21 ensures that the cylindrical object 100 in place on the rollers is held in a precise desired alignment with the print head 30. In particular, a center line along the length of the cylindrical object 100 is held in precise alignment with the center of the linear arrangement of the heat elements 32, to within the associated tight tolerances.

The nose plate 38 may be configured with cut outs, as shown, that fit around various motors and/or mechanical features that may be located within the print assembly 300 and operate under the control of the control sub-system 80. The cut outs allow the nose place 38 to mount to the print assembly and position the print head relative to, for example, the pressure activator 36 that is included in the print assembly 300 and operates under the control of the control sub-system 80.

The cylinder print module 20 includes end plates 28 that support the rollers 25 and 26 and the alignment mechanism 21 that cooperates with the alignment blade 34. The alignment mechanism 21 includes shaped slots 22 that receive the edges 33 of the alignment blade 34. The slots 22, or at least vertical portions of the slots, are sized to the thickness of the alignment component, here the alignment blade 34, within a tolerance of thousands of an inch. An optional adjustable stop 29 may be included to aid in the positioning of the cylindrical object 100 on the module 20. The end plates 28 may be shaped to direct the cylindrical object into a designated location on the module, namely, on top of and centered on the rollers 25 and 26. As illustrated, each end plate 28 includes a strategically slanted and curved portion 27 that essentially allow placement of the object to the designated location and clearance for features of the cylinder, such as, a clip of a pen, during rotation.

The cylinder print module 20 is dimensioned such that the predetermined location on the module, in the example a center line between the two rollers 25 and 26, is a predetermined distance from the alignment mechanism 21, in particular from, for example, the rear wall 23*a* or front wall 23*b* of the slots 22. In the example, the distance is determined from the front wall 23*b* since the motion of the flat bed 40, which, as discussed below, controls the rotation of the rollers, tends to force the module in a direction to the right in the drawings, and thus, allows alignment blade 34 to contact the front wall of the slots.

The predetermined distance between the center line and the appropriate wall of the slot corresponds to the separation between the print head 30 and the alignment blade 34 along the X-axis, such that when the alignment blade 34 is engaged within the slots 22, the center line between the two rollers is in a predetermined position with respect to the print head 30. The engagement of the alignment blade with the slots, which as discussed are sized to within tolerances of thousandths of an inch of the blade thickness, prevents the module from moving out of alignment as the flat bed moves.

The cylinder print module 20 rests on the flat bed 40 but does not attach to the flat bed. The rollers 25 and 26 that support and control the rotation of the cylindrical object 100 contact the surface of the flat bed, such that the rollers rotate as the flat bed moves along the rails 50. The flat bed moves in synchronism with the strobing of the print head 30, and thus, the rollers 25 and 26, in turn, rotate the cylindrical object 100 in place on the rollers in synchronism with the strobing of the print head. As appropriate, the thermal media may be advanced by the thermal media advancement assembly 60 in synchronism also with the strobing of the print head and the movement of the flat bed. Alternatively, the thermal media may be overdriven using a DC motor and a slip clutch that operate under the control of the control system 80, such that the advancement of the thermal media is non-synchronous with the strobing of the print head, while the movement of the flat bed is in synchronism with the strobing of the print head.

The rollers 25 and 26, which may be made of urethane or rubber, allow some compression to straighten warped or otherwise non-perfect printing surfaces of the cylinder object 100 during the printing operation. A plurality of support rods 52 hold the end plates 28 in place and provide rigidity to the cylinder print module 20.

As shown in FIG. 2, an optional removable table 46 may be installed on the flat bed 40, to protect the surface 42 of the flat bed 40 from possible wear and tear associated with contact with the rollers 25 and 26. The removable table 46, which is installed on the flat bed prior to installation of the cylinder print module 20, moves with the flat bed and is sized to the maximum rotational movement of the rollers during a cylinder print operation.

The removable table 46 includes edge connectors 48 that engage edges 43 of the flat bed. At least one of the edge connectors 48 includes a plunger 47 that engages a corresponding hole 45 (shown in dotted lines) in bottom surface 49 of the flat bed, to retain the removable table 46 in place during the cylinder print operation. When the user removes the cylinder print module 20 at the end of the cylinder print operation, the user also removes the table 46, to allow the printer to then perform a print operation on a flat object.

To position the cylinder print module 20 for a print operation, the user rests the module 20 on the flat bed 40 and moves the module essentially along and/or in parallel to the flatbed 40 toward the first wall 37 of nose plate 38, and thus, toward the alignment blade 34, until the horizontal segments of the slots 22 engage the edges of the alignment blade. The user then lowers the alignment blade until the alignment blade engages the vertical sections 24 of the respective slots and locks the alignment blade in the lower position by tightening a thumb screw 54, to ensure a rigid engagement between the alignment blade 34 and the alignment mechanism 21 of the cylinder print module 20.

As illustrated, the alignment blade 34 attaches to the wall 37 of the nose plate 38 using shoulder screws 57 that are screwed through slotted holes 59 in the alignment blade. The screws 57 are tightly screwed into the nose plate and the loose fitting slots 58 of the alignment blade allow the alignment blade to move along a Y-axis to engage with the shaped slots 22 of the cylinder print module 20 as the module is moved into position for printing. Once the edges 33 of the alignment blade 34 are engaged in the slots 22, the tightening of the thumbscrew 54, rigidly holds the alignment blade in place, to ensure through the engagement of the alignment blade 34 with the alignment slots 22 that the module 20 is directed into and then held in precise alignment with the print head 30 as the print assembly 300 is lowered into position and the pressure builds for printing.

The user places the cylindrical object 100 on the cylindrical print module 20, such the cylindrical object resides at the designated location atop and centered on the two rollers 25 and 26. As discussed, the sloped and curved surface 27 of the end plates 28 and, as appropriate, the stop 29 aid in directing the cylindrical object 100 into the designated location. The sloped and curved surface 27 of the end plates also allow clearance for features of the cylindrical object during rotation. The print assembly 300, under the control of the control sub-system 80, moves the print head downwardly, to bring the print head 30 proximate to the cylindrical object in place on the module 20. The control system directs the movement of the print head based on the dimensions of the cylindrical object, more particularly, the diameter of the cylindrical object, and the print force specified by the user.

As the print head 30 is moved downwardly, the alignment blade 34 brings the cylinder print module 20, and thus, the cylindrical object 100 in place on the module 20, into precise alignment relative to the print head, and more particularly, relative to the heat elements 32 of the print head 30. As discussed, the cooperation between the alignment subsystem 35, in the example, including the alignment blade 34, and the alignment mechanism 21 of the properly dimensioned cylinder print module 22 aligns the cylindrical object 100 with the heat elements 32 on the print head 30, to within the $1/2000^{th}$ of an inch tolerance required for accurate printing on a cylindrical object.

Next, the control sub-system 80 controls the advancement of the thermal media, and directs the strobing of the print head 30 and the movement of the flatbed 40 along the rails 50 in synchronism, in order to print the desired alpha numeric information and/or design. The movement of the flatbed along the rails 50 causes the rollers 25 and 26 to rotate, which, in turn, causes the cylindrical object 100 that is supported by the rollers, to rotate also in synchronism with the strobing of the print head, such that the printing is performed correctly and accurately on the cylindrical object 100. Notably, the cylinder print module 20, which rests on but does not attach to the flat bed 40, does not change position in the X or Y direction relative to the print head 30 as the flat bed 40 travels in the X-direction along the rails 50.

The print head 30 and the cylinder print module 20 remain in precise alignment during the printing operation through the engagement of the alignment subsystem 35 and the alignment mechanism 21. The first cylindrical object 100 may be removed from the module 20 after being printed and a next cylindrical object may be placed on the module 20 for printing, and so forth. Once all of the cylindrical objects are printed and the print assembly 300, under the control of the control sub-system 80, moves the print head upwardly to end the print operation, the user may then loosen the thumb screw 54 to disengage the alignment blade 34 from the slots 22. The user then moves the alignment blade 34 back to its original position along the wall 37 and tightens the thumb screw 54 to retain the alignment blade in place. The user may then remove the cylinder print module 20 and, as appropriate, the removable table 46, and the printer may then be used to print on a flat object that is arranged on the flat bed and travels with the flat bed as the flat bed move along the rails 50.

When the user again wants to print on a cylindrical object, the user re-installs the cylinder print module 20, to again precisely align the center line between the two rollers 25 and 26 with the center line of the heating elements 32 and, as appropriate, before installation of the cylinder print module, the user installs the removable table 46. The printer 10 is then ready to perform a cylinder print operation based on user-supplied alphanumeric and/or design information.

The rollers 25 and 26 are mounted to shafts 25*a* and 26*a* that in turn are supported by the end plates 28. The rollers may include bearings (not shown) that allow the rollers to rotate around stationary shafts. Alternatively, the end plates 28 may include the bearings and support rotating shafts. The spacing of the rollers 25 and 26 may be adjustable relative to the center line, such that the separation between the rollers may be changed to accommodate cylindrical object with different diameters. Accordingly, the end plates may include multiple corresponding sets of locations that support the respective shafts.

Figure 5:
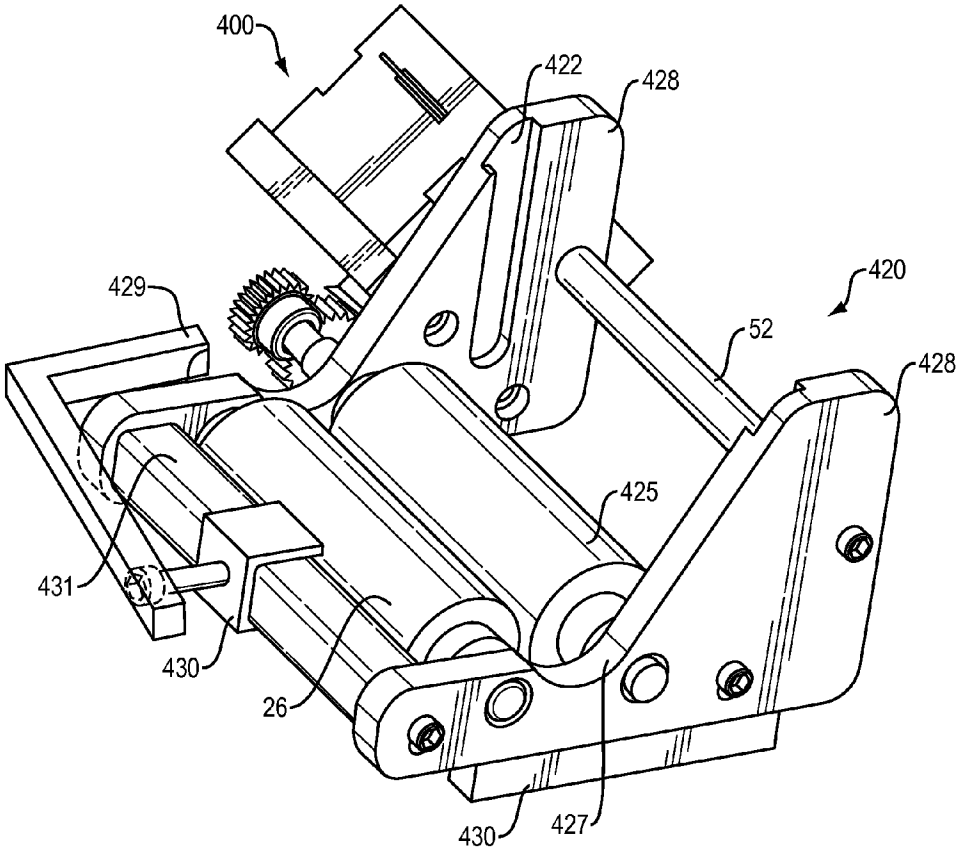
FIG. 5 illustrates an alternative arrangement of the cylinder print module.

In an alternative arrangement as shown in FIG. 5, a module 420 that is otherwise configured in essentially the same manner as the module 20 further includes a motor 400 that drives the rotation of at least one of the rollers 425 and 426, for example, the roller 425, which is referred to herein also as the "drive roller." The motor 400, which may be, for example, a stepper motor or servomotor, operates under the control of a control sub-system 480 (not shown), and receives control signals from the control sub-system via wireless or wired connection.

The cylindrical printing operation is performed as discussed above, however, the rotation of at least the drive roller 425 is controlled by the motor 400, which may be directly coupled to the drive roller as shown in the drawing or coupled to the drive roller through a known transmission arrangement such as, for example, gears, belts and pulleys, a chain and sprocket, and so forth. The control sub-system 480 operates the motor 400 to rotate the drive roller 425, and thus, the cylindrical object 100 in place on the rollers, in synchronism to the strobing of the print head 30 and, as appropriate, the advancement of the thermal media. The flat bed 40 need not move during the cylindrical print operation.

Using the module 420, a bottom plate 430 rests on the flat bed 40 and the rollers 425 and 426 rotate out of contact with the flat bed. Alternatively, the end plates 428 may extend below the rollers, such that the end plates contact the flat bed and hold the rollers out of contact the flat bed 40. As shown, the module 420 includes the bottom plate 429 and a single support rod 52 to hold the end plates 428 in place.

An optional stop 429 may be included. The stop mounts on a bar 430 that is moveable along a rail 431, such that the stop may be appropriately positioned for the size of the cylindrical object.

Figure 6:
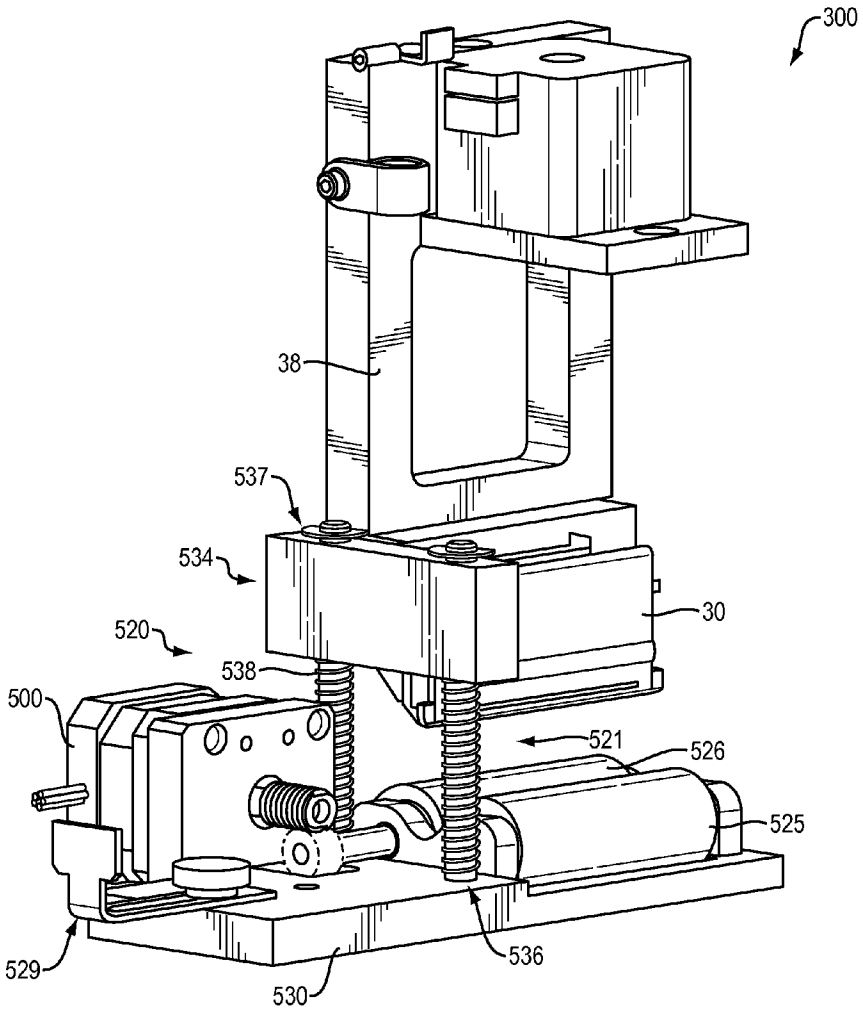
FIGS. 6 and 7 illustrate another alternative arrangement of the cylinder print module.
Figure 7:
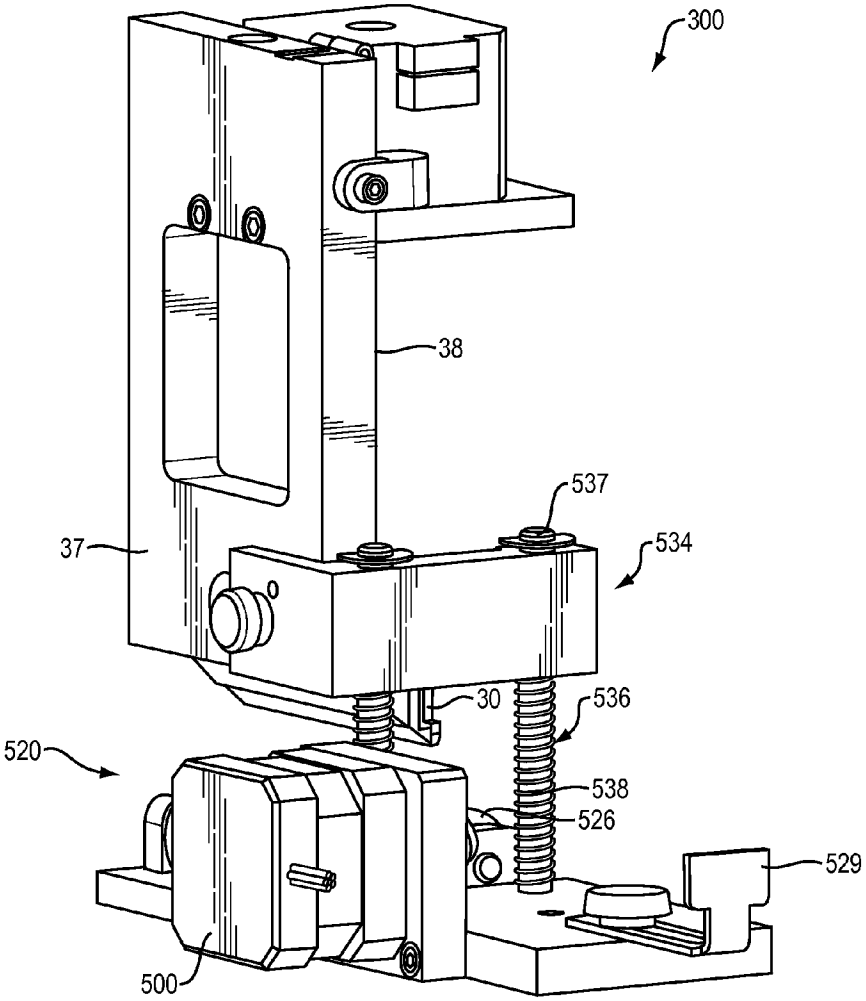

Referring also to FIGS. 6 and 7, the alignment mechanism 521 of a module 520 includes shafts 536 or pins that extend upwardly from a base plate 530 that supports the rollers 525 and 526. An alignment bar, which includes bushings 522 or holes that engage the shafts 536 or pins, attaches to a rear wall 37 of the nose plate 38. Stops 537 on the ends of the shafts retain the bushings on the shafts 536. The alignment bar 534 moves along the shafts, as the print head moves downwardly into position for printing, to align the center line of the rollers with the print head to within the tolerances associated with cylindrical printing. Springs 538 on the shafts aid in positioning the attachment bar along the shafts during attachment of the module. An optional adjustable stop 529 may also be included on the base plate 530.

The alignment bar 534 bar may be L-shaped as illustrated or may instead be shaped to attach along the rear wall 37 of the nose plate 38 with the shafts 536 shifted on the base plate accordingly. The alignment bar may be removably attached to the rear wall of the nose plate 38 with one or more thumb screws 557. Alternatively, the alignment bar may remain attached to the nose plate and the stops 537 on the shafts may be removed such that the shafts can be pulled out engagement with the bushings, to remove the base plate and so forth. For ease of understanding, only a portion of the print head assembly 300 is depicted in the drawings.

The module 520 is illustrated with a motor 500 that rotates at least the drive roller 526. The module may be configured such that the rotation of the rollers 525 and 526 is controlled by the movement of the flat bed 40, as discussed above with reference to FIGS. 1 and 2.

A calibration may be performed at the manufacturer to ensure that the cylindrical print module (shown above with reference to any of the FIGS. 1-7), when installed on the on the printer 10, properly aligns the center line of the rollers to the print head 30. For calibration, the module is installed as discussed above and the alignment between the module and the print head is finely tuned by, as needed, adding a shim (not shown) to the rear of the alignment blade to hold the alignment blade 34 in a desired relationship to the rear wall 37 of the nose plate 38 when the thumb screw 54 is tightened to hold the blade in place. The blade is thus properly positioned to direct the module into position with the center line of the rollers properly aligned with the print head. Alternatively or in addition, the position of the rollers on the module may adjusted by means of an alignment mechanism (not shown), to bring the center line into precise alignment with the print head.

What is claimed is:

1. A thermal transfer printer that utilizes thermal media for printing on flat and cylindrical objects, the printer including a print head with one or more print elements;

a print head assembly that supports the print head and an alignment component of an alignment subsystem that moves with the print head, the print head assembly supporting the alignment component at a predetermined separation from the print head;

a flatbed that supports a flat object during printing on the flat object;

a removable cylindrical print module that is positioned between the print assembly and the flatbed for a cylindrical print operation, the module including endplates that support an alignment mechanism that is shaped to receive and engage with the alignment component of the alignment subsystem to position the module in a predetermined position relative to the print head, and rotatable rollers that support the cylindrical object at a predetermined location on the module and control rotation of the cylindrical object, the end plates providing a separation between the alignment mechanism and a center line of the rollers that corresponds to the predetermined separation between the alignment component and the print head.

2. The printer of claim 1 wherein the removable cylindrical print module is positioned between the print head assembly and the flatbed, and the print head assembly moves the print head downwardly relative to the removable cylindrical print module and the alignment component that moves with the print head is received by the alignment mechanism on the removable cylindrical print module and the alignment component and the alignment mechanism engage to position the cylindrical module in the predetermined position relative to the print head.

3. The printer of claim 2 wherein the flatbed moves relative to the print head during a print operation, and the rollers on the module are in contact with the flatbed and rotate in synchronism with the movement of the flatbed.

4. The printer of claim 2 wherein the alignment component is an alignment blade, and the alignment mechanism includes slots that are shaped to receive and engage with the alignment blade.

5. The printer of claim 2 wherein the alignment component consists of a bar with one or more downwardly extending pins, shafts or both, and the alignment mechanism includes bushings or holes that receive the pins, shafts or both.

6. The printer of claim 1 wherein the end plates are shaped to guide the cylindrical object to the location.

7. The printer of claim 6 wherein the end plates are shaped to allow clearance for features of the cylindrical object during rotation.

8. The printer of claim 1 wherein the alignment mechanism further includes an adjustable stop.

9. The printer of claim 2 wherein the module rests on the flat bed after installation and further includes a motor that drives at least one of the rollers in synchronism with print head operations to control the rotation of the cylindrical object during printing.

10. The printer of claim 2 wherein the flat bed moves relative to the print head during a print operation, the printer further includes a removable table that attaches to and moves with the flat bed, and the rollers on the module are in contact with the removable table and the rollers rotate in synchronism with the movement of the flatbed.

11. The printer of claim 4 wherein the print assembly includes a nose plate that supports the alignment blade on a first wall and a bracket that holds the print head on a second wall, and the alignment blade moves upwardly and downwardly with respect to the nose plate and is held in place by a screw that when tight hold the alignment blade in place, the alignment blade moving downwardly to engage the alignment mechanism and being held in place after engagement by the screw.

12. A thermal transfer printer that utilizes thermal media for printing on flat and cylindrical objects, the printer including a print head with one or more print elements;

a print head assembly that supports the print head and an alignment component of an alignment subsystem that moves with the print head, the print head assembly supporting the alignment component at a predetermined separation from the print head, the alignment component including an alignment blade, and a flatbed that supports a flat object during printing on the flat object;

a removable cylindrical print module that is positioned between the print assembly and the flatbed for a cylindrical print operation, the module including rotatable rollers that support the cylindrical object at a predetermined location on the module and control rotation of the cylindrical object, and endplates that support an alignment mechanism that includes slots that are shaped to receive and engage with the alignment blade to position the module in a predetermined position relative to the print head, the end plates providing a separation between the alignment mechanism and a center line of the rollers that corresponds to the predetermined separation between the alignment component and the print head, and the flatbed moves relative to the print head during a print operation and the rollers are in contact with the flatbed and rotate in synchronism with the movement of the flatbed.

13. The printer of claim 12 wherein the print head assembly moves the print head downwardly relative to the removable cylindrical print module to position the print head for printing, and the alignment slots on the module receive the alignment blade of the alignment component on the print head assembly to position the module in the predetermined position relative to the print head.

14. The printer of claim 13 wherein the print assembly includes a nose plate that supports the alignment blade on a first wall and a bracket that holds the print head on a second wall, and the alignment blade moves upwardly and downwardly with respect to the nose plate and is held in place by a screw that when tight hold the alignment blade in place, the alignment blade moving downwardly to engage the alignment mechanism and being held in place after engagement by the screw.

* * * * *